US008512425B2

(12) United States Patent
Nemoto et al.

(10) Patent No.: US 8,512,425 B2
(45) Date of Patent: Aug. 20, 2013

(54) METHOD FOR TREATING BIO-OIL

(75) Inventors: Isao Nemoto, Chiba (JP); Norio Kouno, Chiba (JP); Eiichiro Sato, Chiba (JP); Minoru Sugiyama, Shizuoka (JP)

(73) Assignee: Nemoto Project Industry Co., Ltd., Chiba (JP)

( * ) Notice: Subject to any disclaimer, the term of this patent is extended or adjusted under 35 U.S.C. 154(b) by 969 days.

(21) Appl. No.: 11/972,206

(22) Filed: Jan. 10, 2008

(65) Prior Publication Data

US 2008/0178521 A1 Jul. 31, 2008

(30) Foreign Application Priority Data

Jan. 11, 2007 (JP) ..... 2007-3684
Apr. 2, 2007 (JP) ..... 2007-96729
Dec. 20, 2007 (JP) ..... 2007-328495

(51) Int. Cl.
*C10L 1/00* (2006.01)
*C10L 1/10* (2006.01)

(52) U.S. Cl.
USPC ..... 44/307; 44/321

(58) Field of Classification Search
USPC ..... 44/307, 605, 321; 508/150, 151
See application file for complete search history.

(56) References Cited

U.S. PATENT DOCUMENTS 2,349,381 A 5/1944 Royce
4,080,178 A * 3/1978 Boyer ..... 44/321
4,080,179 A * 3/1978 Boyer ..... 44/321
4,131,433 A * 12/1978 Scott ..... 44/320
4,781,729 A * 11/1988 Bidwell ..... 44/321
7,635,398 B2 * 12/2009 Bertram et al. ..... 44/605
7,722,755 B2 5/2010 Lawson et al.
2005/0120621 A1 6/2005 Lawson et al.
2005/0188607 A1 * 9/2005 Lastella ..... 44/605
2006/0260184 A1 * 11/2006 Landano ..... 44/308
2008/0178521 A1 7/2008 Nemoto et al.
2010/0204378 A1 8/2010 O'Connor

FOREIGN PATENT DOCUMENTS

CN 101220317 7/2008
EP 1 958 516 8/2008
JP 1-095196 4/1989
JP 6-299187 10/1994
JP 7-305087 11/1995
JP 2001-335793 12/2001
JP 2003-526496 9/2003
JP 2006-241245 9/2006
JP 2006-335982 12/2006

(Continued)

OTHER PUBLICATIONS

Wang Guangxin et al.—China Oil and Fats, vol. 30, Nov. 10, 2005, pp. 66-69.

*Primary Examiner* — James Goloboy
*Assistant Examiner* — Latosha Hines
(74) *Attorney, Agent, or Firm* — Young & Thompson

(57) ABSTRACT

The object of the present invention is to neutralize acidity of bio-oil so as to allow practical use of bio-oil as fuel. Neat liquid of acidic bio-oil is flow in the treatment bath 1. Magnesium powder is added to the liquid from the input chute 3 and the mixture is stirred in the stirrer 7 until the magnesium powder is completely dissolved. The treated oil is taken from the outlet tube 4. The hydrogen gas generated is collected by the suction duct 5, and the reaction heat generated is collected by the heat exchanger 6.

5 Claims, 1 Drawing Sheet

(56) References Cited

FOREIGN PATENT DOCUMENTS

| | | |
|---|---|---|
| JP | 2007-328495 | 12/2007 |
| KR | 2008-0066585 | 7/2008 |
| WO | 87/06431 | 11/1987 |
| WO | 92/20761 | 11/1992 |
| WO | 99/03953 | 1/1999 |
| WO | 2007/128799 | 11/2007 |

* cited by examiner

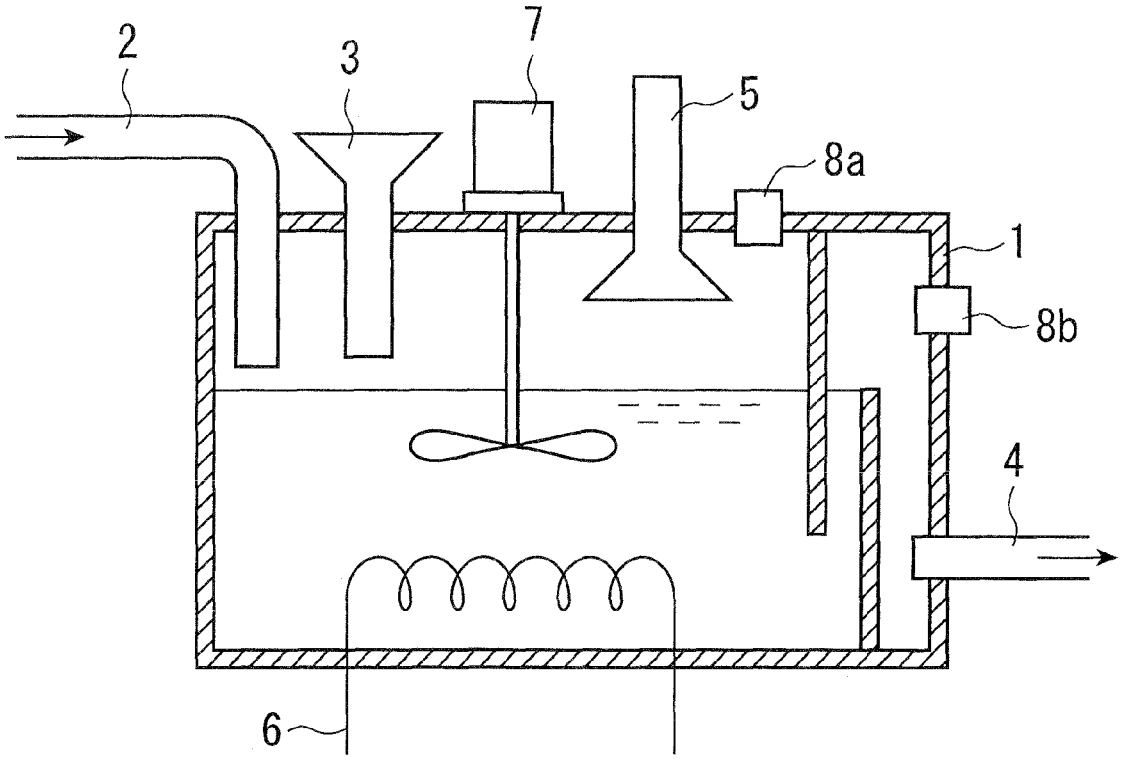
2
3
7
5
8a
1
8b
4
6

METHOD FOR TREATING BIO-OIL

BACKGROUND OF THE INVENTION

1. Field of the Invention

The present invention relates to a method for treating bio-oil collected from coconut husk produced during palm oil press, etc.

2. Description of the Related Art

Palm oil, which is used as a raw material for soap, glycerin, napalm bomb, etc., can be obtained from the fruits of "oil palm" growing in Malaysia, Indonesia, etc. Palm oil can also be used as rolling oil during the production steps of steel plates. On the other hand, coconut husk, which was conventionally disposed after palm oil press, is still rich in oil components. Noting this fact, production of new fuel oil from the coconut husk is attempted although the oil generates slightly lower calorie. For example, oil components are obtained by crushing coconut husk from which oil has been pressed out, vaporizing the oil components by contacting them with particles such as sands heated to high temperature, and condensing the gas using a water-cooling condenser. Besides coconut husk, cereal such as sugarcane, corn, etc. can be used as a raw material. Hereinafter the thus-obtained oil having low purity is referred to as "bio-oil". Organisms such as plants are sometimes considered to be an energy source and referred to as "biomass", and "bio-oil" is synonymous to "biomass oil".

The characteristics of bio-oil obtained from coconut husk raw material are compared to those of heavy oil A, heavy oil C and light oil, and are shown in Table 1.

TABLE 1

| | Heavy oil A | Heavy oil C | Light oil | Bio-oil |
|---|---|---|---|---|
| Reaction | neutral | neutral | neutral | acidic |
| Calorie [kJ/kg] | 45,200 | 44,000 | 46,000 | 16,190 |
| Water content [%] | 0.1 | 0.1 | 0.1 | 31.9 |

The calories of heavy oil A and heavy oil C are each approximately 45,000 kJ/kg, whereas that obtained from bio-oil is approximately 30% (16,190 kJ/kg). In this connection, the calorie originally generated by palm oil is 39,000 kJ/kg (not shown in Table 1).

As is apparent from Table 1, heavy oils and light oil contain little amount of water, whereas bio-oil contains approximately 30% of water. Furthermore, conventional heavy oil is neutral, whereas bio-oil is weak acidic and has a pH of 3.5. This is presumed to be due to acetic acid contained in the bio-oil by the amount of approximately 15%. Furthermore, significant lower calorie of bio-oil than that of heavy oil can be considered to be due to water and acetic acid.

Such acidic bio-oil cannot be practically used for fuel in industry because it causes heavy corrosion of piping, reservoir tanks, etc. On the other hand, when conventional method of neutralization using calcium hydroxide or caustic soda is carried out, calorie of the bio-oil is further decreased and such bio-oil cannot be used as fuel.

SUMMARY OF THE INVENTION

The present invention aims at adjusting the pH value of acidic bio-oil to around neutral without decreasing calorie, whereby allowing practical use of bio-oil as fuel oil, and effectively utilizing reaction heat and reaction gas generated during the treatment.

The present invention is directed to a method for treating bio-oil, the method comprising: adding magnesium, a magnesium compound or a magnesium alloy to a neat solution of bio-oil, or purifying the neat solution of bio-oil while adding magnesium, a magnesium compound or a magnesium alloy; and thoroughly stirring the mixture so as to adjust pH value to a desired value. More desirably, the present invention is directed to a method for treating bio-oil further comprising: adding a predetermined amount of alcohol besides the magnesium, magnesium compound or magnesium alloy; and thoroughly stirring the mixture.

According to the present invention, superior effects that the pH value of acidic bio-oil is adjusted to around neutral and the calorie is increased, whereby practicable fuel oil can be obtained and resource can be effectively utilized, and that reaction gas and reaction heat generated during the treatment can also be utilized, can be exhibited.

BRIEF DESCRIPTION OF THE DRAWING

FIG. 1 is a schematic drawing of a reaction bath according to the embodiment of the present invention.

DESCRIPTION OF THE PREFERRED EMBODIMENT

The method for treating neat liquid of bio-oil according to the present invention is explained with referring to drawings.

FIG. 1 is a schematic drawing of a treatment bath for explaining the treatment to be carried out, in which 1 represents a treatment bath, 2 represents an inlet tube to which the neat liquid flows in, 3 represents an input chute for a treating agent of magnesium, a magnesium compound or a magnesium alloy, 4 represents an outlet tube (outlet) for treated oil, 5 represents a suction duct for generated gas, 6 represents a heat exchanger, 7 represents a stirrer, and 8*a* and 8*b* are safety valves.

A treatment agent is input from the input chute 3 to the neat bio-oil flowing from the inlet tube 2 to the treatment bath 1, and the mixture is sufficiently stirred in the stirrer 7. The treatment agent is magnesium, magnesium compound (e.g., magnesium hydroxide, etc.) or magnesium alloy that is practically used (e.g., aluminum alloy, zinc alloy, etc.), and is preferably in the form of powder so as to increase surface area per weight and accelerate the reaction. The amount of magnesium to be input is sufficient at several grams per 100 ml of neat oil. Magnesium vigorously reacts with acetic acid and generates heat and hydrogen gas. Namely, the following reaction proceeds:

Acetic acid+magnesium→hydrogen+heat

The main reaction is represented by the following chemical equation:

$$2CH_3COOH+Mg \rightarrow H_2+(CH_3COO)_2Mg+x \quad (1)$$

wherein x represents reaction calorie (kcal/mol). The hydrogen gas generated can be collected and effectively used. Furthermore, by providing the heat exchanger 6 in the liquid surface of the reaction bath 1, reaction heat can be taken via a heat medium that is circulating, and utilized.

Although the treatment may be sufficiently continued until the treating agent is completely dissolved, it is the most desirable to determine the endpoint of the treatment by monitoring the pH value. The approximate endpoint of the reaction is neutral, but it may be slightly basic so as to accelerate the reaction of the residue.

The hydrogen gas generated by the reaction is aspirated from the suction duct 5. It is desirable to provide safety valves

8*a* and 8*b* at suitable positions since when the aspiration is stopped due to breakdown, etc., the pressure of hydrogen in the device increases, which may lead to explosion.

The treated bio-oil is taken from the outlet tube 4. Since the acidic bio-oil is neutralized and the water content in the bio-oil is decreased at the same time, fuel oil that does not injure facilities such as piping, reservoir tanks, etc. and that generates high calorie can be obtained.

Furthermore, during the step for purifying bio-oil neat liquid from coconut husk raw material, the pH value can be adjusted to a desired value by adding magnesium, a magnesium compound or a magnesium alloy to a stirring bath in which crushed coconut husk is contacted with particles such as sand heated to high temperature.

It is preferable to add a predetermined amount of alcohol besides magnesium, a magnesium compound or a magnesium alloy.

There are two significances of adding alcohol. Firstly, when an oxide generated by addition of magnesium precipitates in the form of mass, the mass can be decomposed by addition of alcohol, whereby the mass becomes powdery and its flowability is increased. To achieve this object, any kind of alcohol may be used, and the effect can be observed by addition of alcohol of approximately 3% or more relative to neat liquid.

Secondly, calorie of fuel increases in proportion to the amount of alcohol added. In this case, since the more the calorie increases the more alcohol is added, the amount of alcohol to be added can be determined according to the intended use. The calorie as high as that of the light oil for diesel engine shown in Table 1 can be readily realized by the present invention. Furthermore, alcohol having large carbon number, so-called higher alcohol, is not necessarily effective for the present invention. Therefore, methanol or ethanol, which is inexpensive and readily available, is the most suitable in view of economic efficiency, etc.

What is claimed is:

1. A method for treating bio-oil comprising acetic acid, the method comprising:

adding magnesium or a magnesium alloy to a mixture of raw bio-oil, or purifying the mixture of raw bio-oil while adding magnesium or a magnesium alloy;

thoroughly stirring the mixture; and reacting the magnesium or magnesium alloy with the acetic acid in the mixture so as to adjust the pH value of the bio-oil to about neutral.

2. The method for treating bio-oil according to claim 1, wherein the magnesium or the magnesium alloy is in the form of powder.

3. The method for treating bio-oil according to claim 1, further comprising adding a predetermined amount of alcohol to the mixture in addition to the magnesium or the magnesium alloy.

4. The method for treating bio-oil according to claim 3, wherein the alcohol to be added is methanol or ethanol.

5. The method for treating bio-oil according to claim 2, further comprising adding a predetermined amount of alcohol to the mixture in addition to the magnesium or the magnesium alloy.

* * * * *